US008424849B2

(12) United States Patent
James

(10) Patent No.: US 8,424,849 B2
(45) **Date of Patent: *Apr. 23, 2013**

(54) GUARDRAIL

(75) Inventor: Dallas James, Auckland (NZ)

(73) Assignee: Axip Limited, Auckland (NZ)

( * ) Notice: Subject to any disclaimer, the term of this patent is extended or adjusted under 35 U.S.C. 154(b) by 284 days.

This patent is subject to a terminal disclaimer.

(21) Appl. No.: 12/266,927

(22) Filed: Nov. 7, 2008

(65) Prior Publication Data

US 2009/0302288 A1 Dec. 10, 2009

Related U.S. Application Data

(63) Continuation-in-part of application No. 12/132,958, filed on Jun. 4, 2008, now Pat. No. 8,177,194.

(51) Int. Cl.
*E01F 15/00* (2006.01)

(52) U.S. Cl.
USPC ..... 256/13.1

(58) Field of Classification Search ..... 256/13.1
See application file for complete search history.

(56) References Cited

U.S. PATENT DOCUMENTS

| | | | |
|---|---|---|---|
| 1,828,349 | A | 10/1931 | Williams |
| 2,244,042 | A | 6/1941 | Barlow |
| 2,561,206 | A | 7/1951 | Kaspar |
| 2,976,923 | A | 3/1961 | Hirashiki |
| 3,204,606 | A | 9/1965 | Parr |
| 3,350,039 | A | 10/1967 | Crater |
| 3,537,687 | A | 11/1970 | Adelman |
| 3,617,076 | A | 11/1971 | Attwood et al. |
| 3,738,599 | A | 6/1973 | Borehag |
| 3,776,520 | A | 12/1973 | Charles et al. |
| 3,866,397 | A | 2/1975 | Koziol |
| 3,912,404 | A | 10/1975 | Katt |
| 3,982,734 | A | 9/1976 | Walker |
| 4,047,702 | A | 9/1977 | Cernia et al. |
| 4,183,317 | A | 1/1980 | Follick |
| 4,222,552 | A | 9/1980 | Matteo |
| 4,330,106 | A | 5/1982 | Chisholm |
| 4,498,660 | A | 2/1985 | Brema et al. |
| 4,655,434 | A | 4/1987 | Bronstad |
| 4,674,911 | A | 6/1987 | Gertz |
| 4,678,166 | A | 7/1987 | Bronstad et al. |
| 4,681,302 | A | 7/1987 | Thompson |
| 4,730,810 | A | 3/1988 | Rambaud |
| 4,739,971 | A | 4/1988 | Ruane |
| 4,844,424 | A | 7/1989 | Knudslien |
| 5,022,782 | A | 6/1991 | Gertz et al. |
| 5,123,773 | A | 6/1992 | Yodock |

(Continued)

FOREIGN PATENT DOCUMENTS

| | | |
|---|---|---|
| AU | 199674061 | 6/1997 |
| CA | 2167548 | 1/1996 |

(Continued)

*Primary Examiner* — Victor MaCarthur
(74) *Attorney, Agent, or Firm* — Greer, Burns & Crain, Ltd.

(57) ABSTRACT

An impact slider assembly for a guardrail which includes: a slider mechanism attached to a first rail and second rail which substantially conforms with a rail profile; and an integral means for attachment to the first rail, wherein the slider mechanism gathers telescoping rails whilst substantially maintaining the strength of the rails in a fully re-directing manner.

9 Claims, 9 Drawing Sheets

U.S. PATENT DOCUMENTS

| | | | |
|---|---|---|---|
| 5,207,302 | A | 5/1993 | Popp et al. |
| 5,391,016 | A | 2/1995 | Ivey |
| 5,435,524 | A | 7/1995 | Ingram |
| 5,609,327 | A | 3/1997 | Amidon |
| 5,664,905 | A | 9/1997 | Thompson |
| 5,729,607 | A | 3/1998 | DeFries et al. |
| 5,797,591 | A | 8/1998 | Krage |
| 5,820,110 | A | 10/1998 | Beu |
| 5,851,005 | A | 12/1998 | Muller et al. |
| 5,921,021 | A | 7/1999 | Coates |
| 5,967,497 | A | 10/1999 | Denman et al. |
| 6,059,491 | A | 5/2000 | Striefel et al. |
| 6,065,738 | A | 5/2000 | Pearce et al. |
| 6,065,894 | A | 5/2000 | Wasson |
| 6,085,458 | A | 7/2000 | Gau |
| 6,109,597 | A | 8/2000 | Sicking et al. |
| 6,149,134 | A | 11/2000 | Bank et al. |
| 6,173,943 | B1 | 1/2001 | Welch et al. |
| 6,290,427 | B1 | 9/2001 | Ochoa |
| 6,299,141 | B1 | 10/2001 | Lindsay et al. |
| 6,398,192 | B1 | 6/2002 | Albritton |
| 6,409,417 | B1 | 6/2002 | Muller et al. |
| 6,488,268 | B1 | 12/2002 | Albritton |
| 6,558,067 | B2 | 5/2003 | Ochoa |
| 6,619,630 | B2 | 9/2003 | Albritton |
| 6,729,607 | B2 | 5/2004 | Alberson et al. |
| 6,863,264 | B2 | 3/2005 | Johansson et al. |
| 6,902,150 | B2 | 6/2005 | Alberson et al. |
| 6,926,462 | B1 | 8/2005 | Fuganti et al. |
| 6,932,327 | B2 | 8/2005 | Alberson et al. |
| 6,948,703 | B2 | 9/2005 | Alberson et al. |
| 6,962,328 | B2 | 11/2005 | Bergendahl |
| 7,086,805 | B2 | 8/2006 | Smith et al. |
| 7,216,854 | B2 | 5/2007 | Bryan |
| 7,234,275 | B1 | 6/2007 | Haggy et al. |
| 7,396,184 | B2 | 7/2008 | LaTurner et al. |
| 7,445,402 | B1 | 11/2008 | Chen |
| 7,537,411 | B2 | 5/2009 | Yodock, Jr. et al. |
| 7,699,293 | B2 | 4/2010 | James |
| 7,722,282 | B2 | 5/2010 | Meidan |
| 7,926,790 | B2 | 4/2011 | James |
| 2001/0013596 | A1 | 8/2001 | Sicking et al. |
| 2001/0048846 | A1 | 12/2001 | Ochoa |
| 2002/0025221 | A1 | 2/2002 | Johnson |
| 2002/0179894 | A1 | 12/2002 | Albritton |
| 2004/0140460 | A1 | 7/2004 | Heimbecker et al. |
| 2005/0007507 | A1 | 1/2005 | Ono et al. |
| 2005/0036832 | A1 | 2/2005 | Smith et al. |
| 2005/0047862 | A1 | 3/2005 | Smith et al. |
| 2005/0063777 | A1 | 3/2005 | Smith et al. |
| 2005/0077507 | A1 | 4/2005 | Heimbecker et al. |
| 2005/0077508 | A1 | 4/2005 | Bronstad |
| 2006/0013650 | A1 | 1/2006 | Meidan |
| 2006/0017048 | A1 | 1/2006 | Alberson et al. |
| 2006/0054876 | A1 | 3/2006 | LaTurner et al. |
| 2006/0102883 | A1 | 5/2006 | Troutman et al. |
| 2007/0102689 | A1 | 5/2007 | Alberson |
| 2007/0252124 | A1 | 11/2007 | Heimbecker |
| 2008/0000062 | A1 | 1/2008 | Boltz |
| 2009/0146121 | A1 | 6/2009 | Sharp et al. |

FOREIGN PATENT DOCUMENTS

| | | |
|---|---|---|
| DE | 102006038336 | 12/2007 |
| EP | 0816568 | 1/1998 |
| EP | 0924348 | 6/1999 |
| EP | 1152104 | 7/2001 |
| EP | 1612333 | 1/2006 |
| EP | 1619308 | 1/2006 |
| FR | 2701046 | 8/1994 |
| FR | 2846673 | 5/2004 |
| NZ | 528396 | 9/2004 |
| WO | WO 96/29473 A1 | 9/1996 |
| WO | WO 98/44203 A1 | 10/1998 |
| WO | WO 99/32728 A1 | 7/1999 |
| WO | 03064772 | 8/2003 |
| WO | WO 2005028757 A1 * | 3/2005 |

* cited by examiner

FIGURE 8A
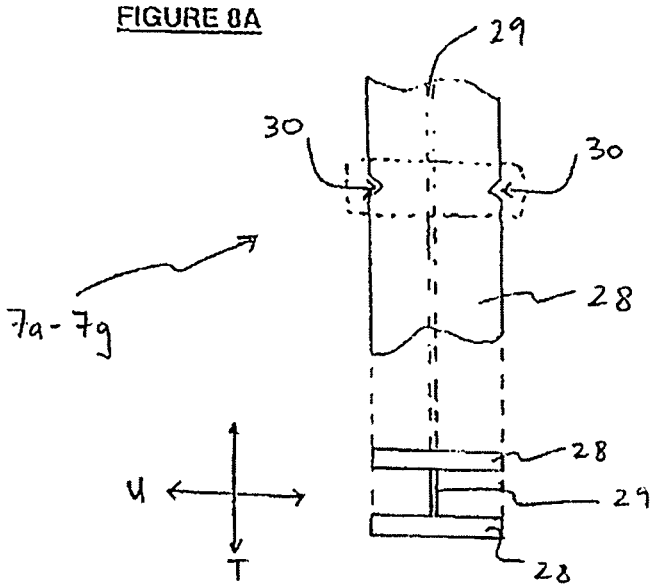
FIGURE 8B
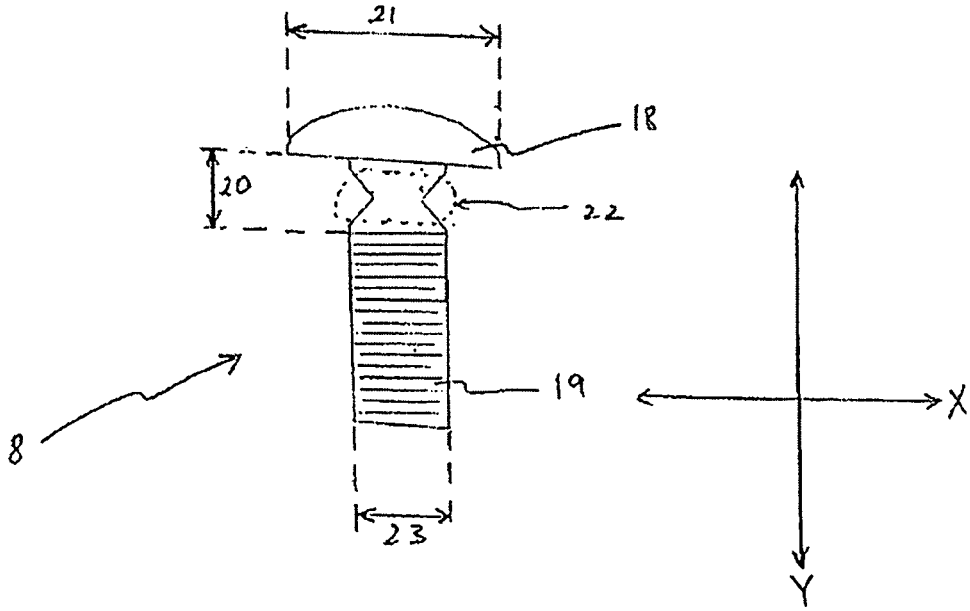
FIGURE 7

GUARDRAIL

CROSS REFERENCE TO RELATED APPLICATION

This application claims the benefit of 35 U.S.C. §120 as a Continuation-in-Part of U.S. application Ser. No. 12/132,958, filed Jun. 4, 2008 now U.S. Pat. No. 8,177,194.

TECHNICAL FIELD

This invention relates to guardrails and in particular, though not solely, to guardrails and/or guardrail impact heads for use in roading networks and/or vehicle road lanes requiring separation by a barrier.

BACKGROUND ART

Existing highway guardrail end treatment systems include: the breakaway cable terminal (BCT), the eccentric loader terminal (ELT), the modified eccentric loader terminal (MELT), the vehicle attenuating terminal (VAT), the extruder terminal (ET 2000 and ET plus), the slotted rail terminal (SRT), the sequential kinking terminal (SKT) and the flared energy absorbing terminal (FLEAT).

Terminal ends (that is, the end facing oncoming traffic) generally consist of one or more, often three, W shaped (in cross-section) guardrails supported by a series of both controlled release terminal (CRT) or frangible posts and standard highway guardrail posts. Generally a cable assembly arrangement is utilised that anchors the end of the rail to the ground, transferring tensile load developed in a side-on impact by an errant vehicle to the ground anchor. Generally the terminal ends have an impact head arrangement that will be the first part impacted by an errant vehicle during an end-on impact which is designed to spread or absorb some of the impact energy.

Some terminal ends such as the abovementioned ET, SKT and FLEAT, absorb the energy of the impacting vehicle during an end on impact by having an impact head that slides down the W shaped guardrails, extruding it and breaking away the support posts as it travels down the rails. All of the other abovementioned terminal ends work on the principal of various weakening devices in the posts and rails to allow an errant vehicle to penetrate the terminal end in a controlled manner and prevent the rails from spearing the vehicle or the vehicle from vaulting or jumping over a relatively stiff terminal end.

All of the abovementioned guardrail terminal ends are considered to be gating, that is, if impacted between the impact head and the "length of need" (where the "length of need" is considered to be the distance from the terminal end to where the guardrail will redirect a vehicle during an angled impact) during an angled impact, the terminal end will gate and allow the errant vehicle to pass to the back side of the terminal end. However this gating effect may have undesirable or unsafe results, and preferably an improved or safer or varied energy absorbing system is utilised to control errant vehicle barrier/guardrail impacts.

It is therefore an object of the present invention to provide a guardrail and/or guardrail impact head which will go at least some way towards addressing the foregoing problems or which will at least provide the industry with a useful choice.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

Further aspects and advantages of the present invention will become apparent from the ensuing description which is given by way of example only.

DISCLOSURE OF INVENTION

Accordingly, in a first aspect, the invention may broadly be said to consist in an impact head for a guardrail comprising:

a cable routing means which forms a tortuous path through which a cable is adapted to be threaded in order to provide resistance to cable movement therethrough.

The inventor considers that a barrier may be defined as: "A barrier formed from rails or cables, placed along an edge of a road or highway, particularly at dangerous points in the road."

Preferably, the path of the cable through the cable gripping means includes at least one substantially 180° turn.

Preferably, the path of the cable through the cable gripping means is substantially an S or Z-shape.

Preferably, during a collision or impact with the impact head the cable is forced through the cable gripping means, where resistance to cable movement substantially facilitates impact energy dissipation.

Preferably, the cable routing means comprises a planar bar member having at least three cable entry ports provided therein through which a cable is adapted to be threaded in series and which forms the tortuous path and, provides resistance to cable movement.

Preferably, the cable routing means comprises a bar member having a longitudinal axis and including a cable entry port adapted to allow a cable to pass directly therethrough when said bar member is in a first non-cable-gripping orientation, and wherein upon rotation of said bar member through at least 90° about said longitudinal axis, a second cable-gripping orientation is reached.

Preferably, said bar member may be secured in the second orientation by locking means.

Preferably, said locking means comprise bolts or screws.

Preferably, rotation of the bar member from said first orientation to said second orientation ensures that the cable follows a tortuous pathway.

In a second aspect, the invention may broadly be said to consist in a guardrail comprising:

a plurality of spaced apart support posts at least some of which have a predetermined failure load, a plurality of rails slidably interconnected and mounted directly or indirectly to said posts, at least one cable provided along at least a part of the length of said slidably interconnected rails wherein each end of said at least one cable is fixed in relation to the ground and an impact slider means substantially surrounding a first rail and including a portion which gathers and retains telescoping rails during an impact.

Preferably, said at least one cable is substantially located within aligned recesses of the plurality of slidably interconnected rails.

Preferably, the at least one cable is tensioned.

Preferably, the at least one cable is anchored to a ground anchor at at least one end.

Preferably, the remaining end of the at least one cable is anchored to a rail and/or a support post.

Preferably, the support posts of predetermined failure load have a substantially horizontal region of weakness.

Preferably, where the at least one cable is anchored to a support post without a predetermined failure load, the support post has a greater failure load than that of the predetermined failure load support posts.

Preferably, the slidably connected rails telescope upon an impact substantially in-line with the longitudinal direction of the slidable rails.

Preferably, the rails are separated from the support posts by a spacer.

Preferably, frangible fasteners connect a plurality of rails to one another and/or to said posts.

Preferably, the impact slider means is attached to the end of a first rail at or near a connection with a second rail, wherein the impact slider device is slidable along the second rail.

Preferably, the movement of the impact slider means along the second rail disconnects the second rail from its associated post or posts.

In a third aspect, the invention may broadly be said to consist in a guardrail comprising:

a plurality of spaced apart support posts, at least some of which have a predetermined failure load, a plurality of rails slidably interconnected and mounted directly or indirectly to said posts, at least one cable provided along at least a part of the length of said slidably interconnected rails wherein each end of said at least one cable is fixed in relation to the ground, and an impact head in accordance with the first aspect positional at one end of the slidably interconnected rails and through which at least one of said at least one cable is routed in said tortuous path.

Preferably, the end of at least one cable located furtherest from the cable gripping means is anchored to a rail and/or a support post.

Preferably, the impact head is mounted to a first support post.

Preferably, the impact head is mounted to a rail.

Preferably, the cable routing means is mounted to a first support post.

Preferably, the cable routing means is mounted to a rail.

Preferably, the cable routing means is connected to an end of a plurality of interconnected rails.

Preferably, the impact slider means is a housing which substantially surrounds a rail.

Preferably, the impact slider substantially conforms with the rail profile.

Preferably the impact slider impacts the rail and post connections and disconnects the rail and post.

Preferably, the means for gathering and retaining the impact slider includes telescoping during an impact.

Preferably, the means for gathering and retaining is a pair of L-shaped arms extending rear-wardly from the impact slider, in the direction of the support post.

Preferably, the cable routing means is mounted on a first post, the impact slider device is attached to the end of a first rail, wherein the impact slider device is slidable along a second rail overlapping the end of the first rail.

In a fourth aspect, the invention may broadly be said to consist in a frangible fastener comprising:

a head portion, and a tail portion with a shank portion therebetween, wherein the head portion has a minimum cross-sectional diameter greater than the maximum cross-sectional diameter of the tail portion, and wherein the shank portion includes a frangible zone, having a minimum cross-sectional diameter smaller than the tail portion's maximum cross-sectional diameter.

Preferably, the frangible zone is formed by the convergence of a tapered reduction in the cross-sectional diameter of the shank portion.

Preferably, the frangible zone is located within the ends of the shank portion.

Preferably, the frangible fastener structurally fails substantially at the frangible zone upon a force loading in shear to the frangible fastener's longitudinal axis.

Preferably, the frangible fastener comprises a threaded securing means.

In a fifth aspect, the invention may broadly be said to consist in a frangible post comprising:

a first member substantially orthogonally connected to a second member, wherein the at least one first member has a region of weakness.

Preferably, the at least one region of weakness is formed by a cut-away or notch section from the first member.

Preferably the first and second members are integral or welded together.

Preferably, the first and second members are connected in one of the following configurations: an L-beam, an I-beam, an X-beam or a T-beam.

Preferably, two first members are connected to said second member in an I-beam configuration.

Preferably, the post is sunk into the ground, with the at least one region of weakness being near or at ground level.

In a first aspect the present invention provides an impact slider assembly for a guardrail including a slider connected to a first rail substantially surrounding the first rail so that in use, the slider bracket gathers and retains the first and any subsequent rails which telescopically overlap with each other during an impact.

Preferably, the rails telescope upon an impact substantially in-line with the longitudinal direction of the rails.

Preferably, the impact slider is connected to an end of the first rail at or near a connection with the second rail.

Preferably, the impact slider is adapted so that, in use, it may impact the rail and support post connections and disconnect the rail and support post.

Preferably, the connection between the impact slider and the support post is frangible.

Preferably, one or more of the support posts has a predetermined failure load.

Preferably, the predetermined failure load is by virtue of a substantially horizontal region of weakness in the support post.

In a further aspect the present invention also provides a guardrail including:

a plurality of support posts, a plurality of rails slidably interconnected and mounted directly or indirectly to said posts, and an impact slider means substantially surrounding a first rail and including a portion which gathers and retains telescoping rails during an impact.

BRIEF DESCRIPTION OF DRAWINGS

Further aspects of the present invention will become apparent from the following description which is given by way of example only and with reference to the accompanying drawings in which:

FIG. 7: is a front elevational view of an embodiment of a frangible fastener according to the present invention;

FIG. 8*a*: is a front elevational view of a frangible post in accordance within the present invention;

FIG. 8*b*: is a plan view of the frangible post of FIG. 8*a;*

BEST MODES FOR CARRYING OUT THE INVENTION

This invention is designed to be a substantially non-gating guardrail, meaning that at any point along the side of the guardrail from the terminal end onwards, an impacting vehicle on an angled collision may be substantially redirected away from its initial impact trajectory. It is also designed to substantially absorb energy during an end on impact to the terminal end.

"Gating" is a term used within the guardrail industry to refer to sections of guardrail which are unable to withstand high impact side angle collisions, and significant guardrail deformation or ultimate failure or breakage may occur.

Figure 1B:
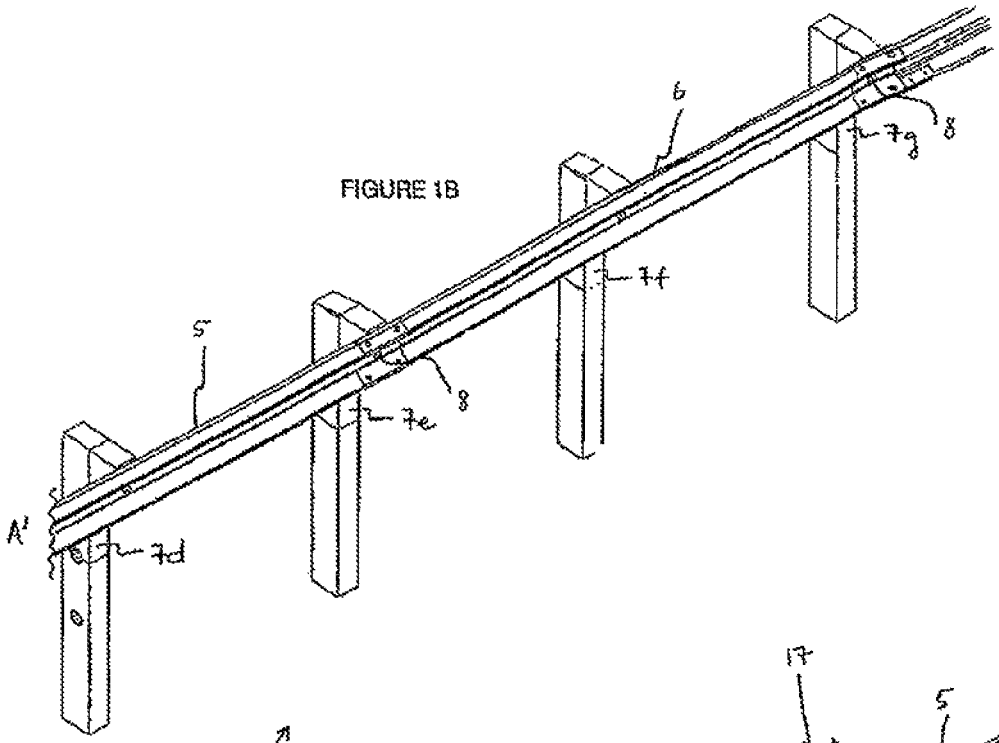
FIGS. 1*a* and 1*b*: are perspective views from the impact side of one embodiment of a guardrail according to the present invention.
Figure 1A:
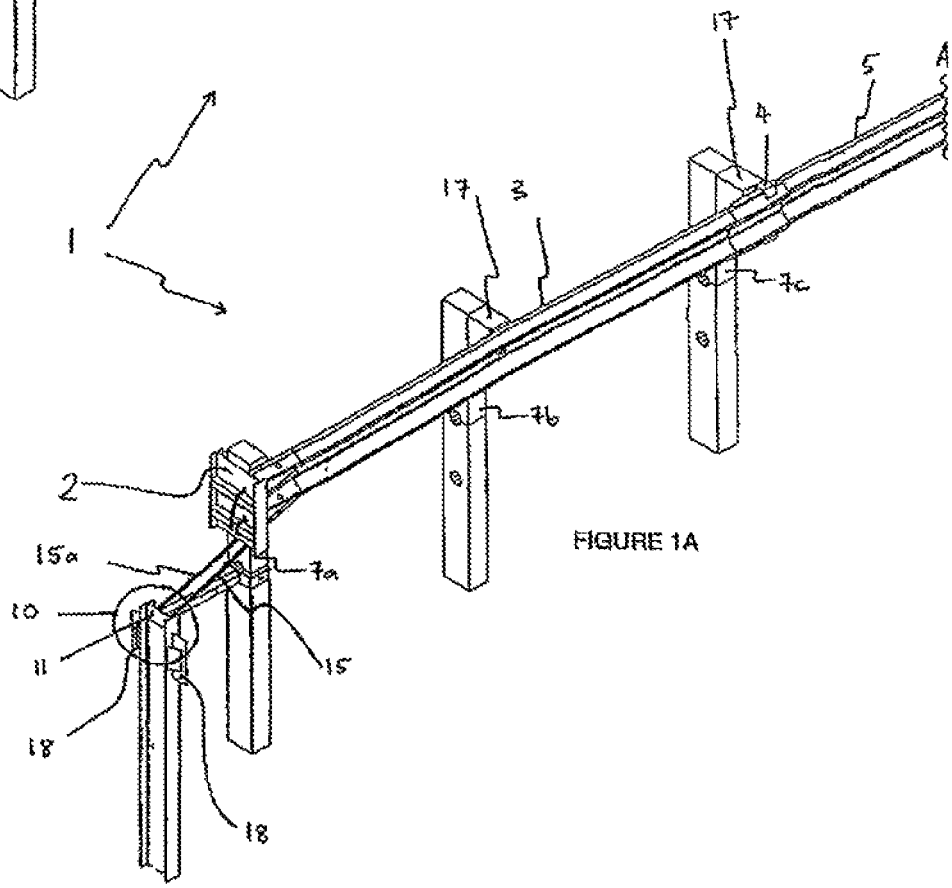
Figures 2A, 2B:
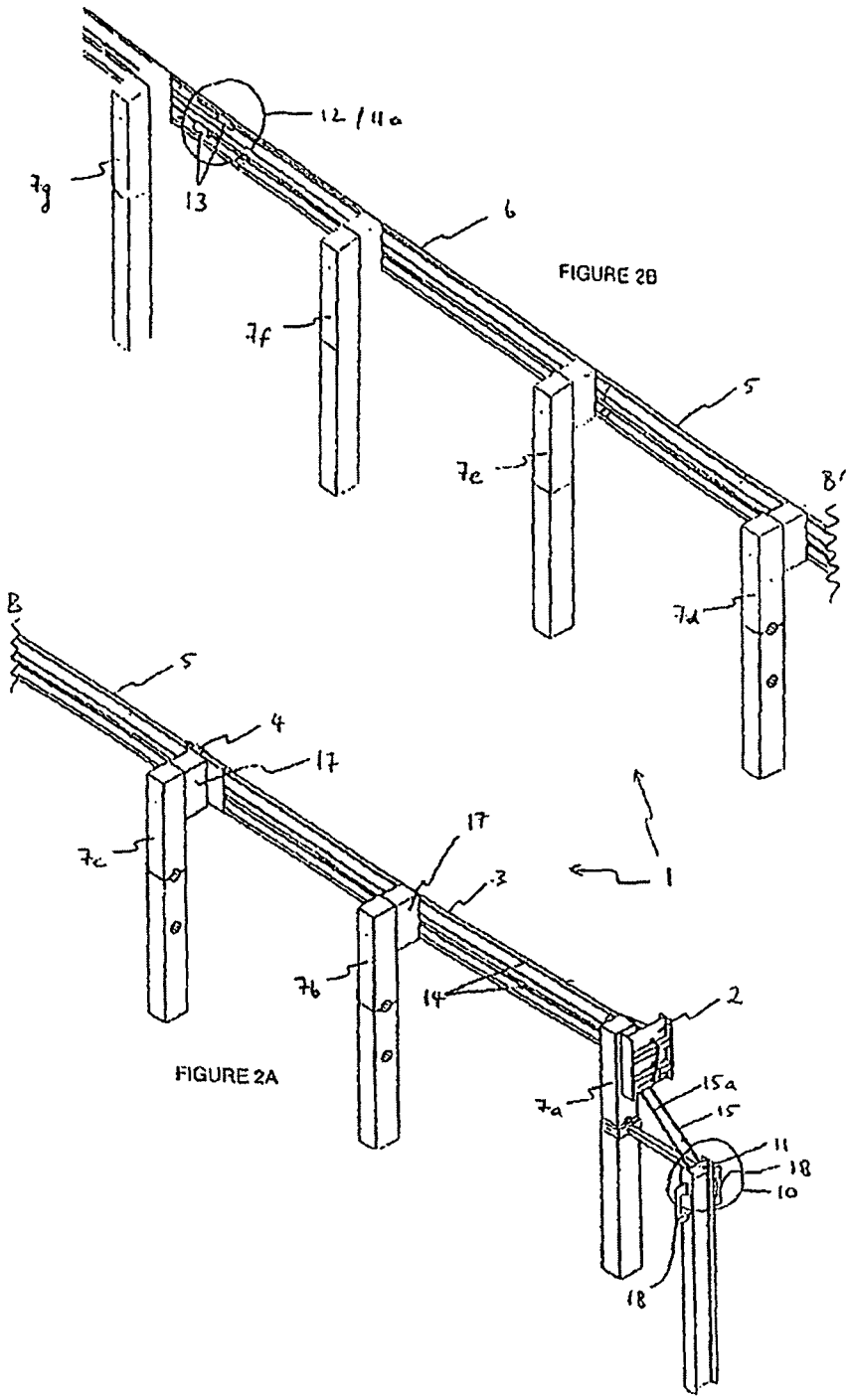
FIGS. 2*a* and 2*b*: are reverse perspective views of the guardrail of FIGS. 1*a* and 1*b*.
Figure 3:
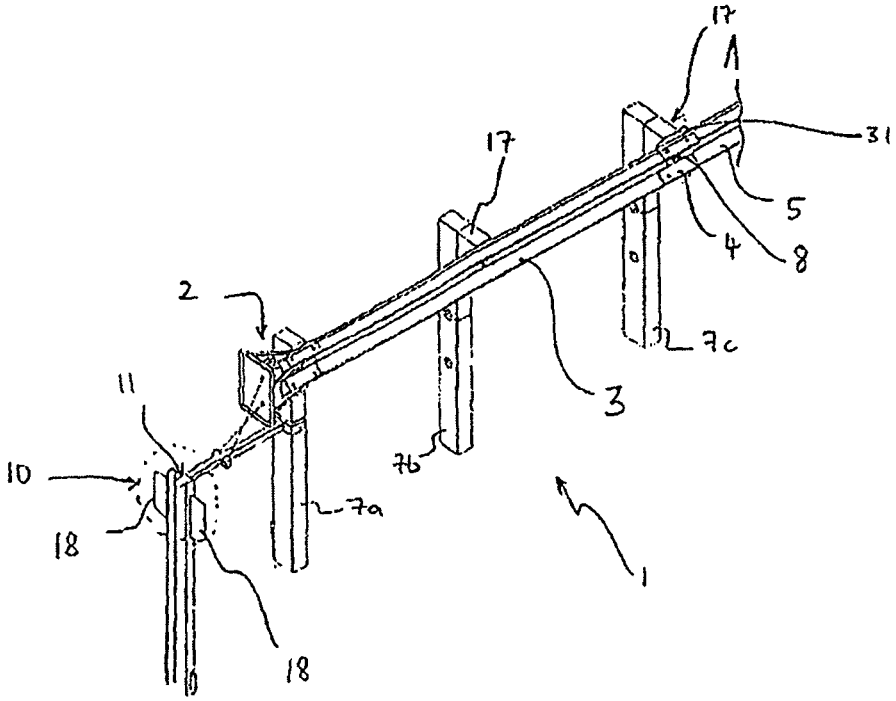
FIG. 3: is an alternative embodiment of the guardrail of FIG. 1*a*.

For the purposes of this illustrative description, FIGS. 1*a* and 1*b* will be referred together as FIG. 1; similarly FIGS. 2*a* and 2*b* will be referred to as FIG. 2. The guardrail 1 shown has been split into two sections for illustrative purposes only, and sections A and A' in FIGS. 1*a* and 1*b*; and the same sections are labelled B and B' in FIGS. 2*a* and 2*b* should be joined to show an embodiment the guardrail according to the present invention.

In a first embodiment of the present invention, and with reference to FIGS. 1 and 2 there Is provided a guardrail 1 with a cable routing or gripping means 2 at the terminal end. The cable gripping means 2 may form part of an impact head (where an impact head is an additional guardrail bumper used to initially absorb some impact energy).

The cable gripping means 2 (and optionally impact head) may be bolted to the first rail 3, at the other end of which is connected an impact slider device 4. The impact slider device 4 may facilitate the sliding of the first rail over each subsequent rail, thereby providing substantial telescoping ability to the guardrail, with each rail overlapping the next rail to enable this process during an end-on impact. The impact slider device may substantially surround the first rail and advantageously includes a portion 31 which gathers and retains telescoping railings during an impact.

The rails 3, 5, 6 may be supported by upstanding CRT (controlled release terminal) 7*a*, 7*b*, 7*c*, 7*d* and/or frangible posts and/or posts of a predetermined failure load or any combination of these post types. The rails may be directly attached to the posts, or alternatively may be indirectly attached via a spacer 17 or similar block type arrangement.

The impact slider device 4 may also be used to detach or facilitate the disjointing or disconnection of a connection such as bolt 8 between a rail 5 and a support post 7. Preferably the impact slider device 4 is a structural member of suitable strength that allows the bolts 8 (or similar connector) connecting rail 5 to posts 7*a*-7*g*; or rail 5 to rail 3 or the next rail 6; to either be severed from the rail or pulled or bent free from the rail connection. The rails 3, 5, 6 may be connected to each other separately from support post connections. Depending on the strength and/or impact force generate by an impact with guardrail terminal end and subsequently the slider, the bolts 8 may be made of materials such as plastics or high density plastic or other composite materials, or frangible bolts, which are more likely to fail and be sheared off from the post connection (or from the rail to rail connection) by an impact from the slider, than a side angle impact with the guardrails. This may be an advantageous feature allowing the slider to operate and shear off post holding rail bolts 8, whilst at the same time providing resistance to side angle impacts and reducing the likelihood of the guardrail gating.

In an alternative to plastic or weaker material bolts, a fastener 8 composed of high strength materials or even a "standard" mild steel bolt could be structurally altered to provide frangible characteristics. For example, an alternative frangible fastener 8 is shown in FIG. 7. The frangible bolt includes a head portion 18, a tail portion 19 with a shank portion 20 therebetween. The head portion has a minimum cross-sectional diameter 21 greater than the maximum cross-sectional diameter of the tail portion, and the shank portion includes a frangible zone 22 having a minimum cross-sectional diameter smaller than the tail portion's maximum cross-sectional diameter 23.

Advantageously, the frangible zone can be formed by the convergence of a tapered reduction in the cross-sectional diameter of the shank portion, with the frangible zone being located in the shank portion.

In addition, the frangible fastener may structurally fail substantially at the frangible zone upon a force loading in shear direction X, to the frangible fastener's axial direction, that is, at an orthogonal direction to the fastener's longitudinal or axial direction.

Ideally, the frangible fastener is a bolt, screw or similar threaded securing means. Such a securing means can be used to connect the guardrail rails to the support posts, and may be especially suitable for use with the guardrail slider device. For instance, the slider can impact the frangible fastener holding the rails onto the support posts, the fastener will be subjected to a shear force or impacting force, and as a consequence of the weakened fastener shank portion, the fastener can break (or structurally fail). Whereas, an impact with the fastener in a direction in-line with the longitudinal axis, that is in direction Y, of the fastener is less likely to induce fastener failure, as the impacting force is transferred down the length of the fastener and is not exposed to any regions of frangibility or weakness.

For example, the frangible bolt as illustrated in FIG. 7 should preferably have a 6 mm shank length, 16 mm tail cross-sectional diameter, and an 8.5 mm cross-sectional diameter at the narrowest section of the frangible zone.

A cable 15 has an end 10 which may be attached to a soil anchor assembly or fixed such as at 11, at the terminal end of the guardrail. The other cable end 11*a* extends to a second anchor or fixed point 12, which may be a further soil anchor assembly, or alternatively, may be an anchoring assembly attached to a non-frangible support post or non-telescoping rail. The cable 15 may be anchored by cable brackets 13 to the posts or rails or by any suitable cable anchoring system, such as bolts and welds or the like. The soil anchor assembly arrangement may include a sunken post (or I-beam) with flares or winged portions 18 extending outwards from the post to engage with greater soil area and providing increased resistance to movement of the anchor assembly as a result of an impact with the guardrail.

The embodiment shown in FIGS. 1 and 2 of a guardrail system consists of a soil anchoring system 11 at the terminal end of the guardrail and provides a means to attach two cables 15, 15*a* thereto. The cables are preferably threaded in a substantially S-shape (or Z-shape), through the cable gripping means 2, which may be a steel plate bolted to the terminal end of a length of rail 3 (or first post 7*a*). At the junction of the first 3 and second 5 rails (or sections of rails), there is an impact slider device or "slider" 4 that fits over the end of the first rail 3 and into which the next rail 5 may slide.

The cables 15, 15*a*, after being threaded through the cable gripping means 2, are positioned in a hollow or recess 14 of the back side of the length of the rail (for example, the rail may be a W-shaped beam). The cables may extend until a point 11*a* where they may be anchored to the rail (or post, or other anchoring means) at a post downstream of the cable gripping means 2 using one or more cable brackets 13 or other connecting and/or cable fixing means. Such means may be screw bolts, welded joints or other suitable devices enabling substantially secure cable anchoring. The cable may be tensioned, although this is not essential for the present invention to operate.

Figure 4:
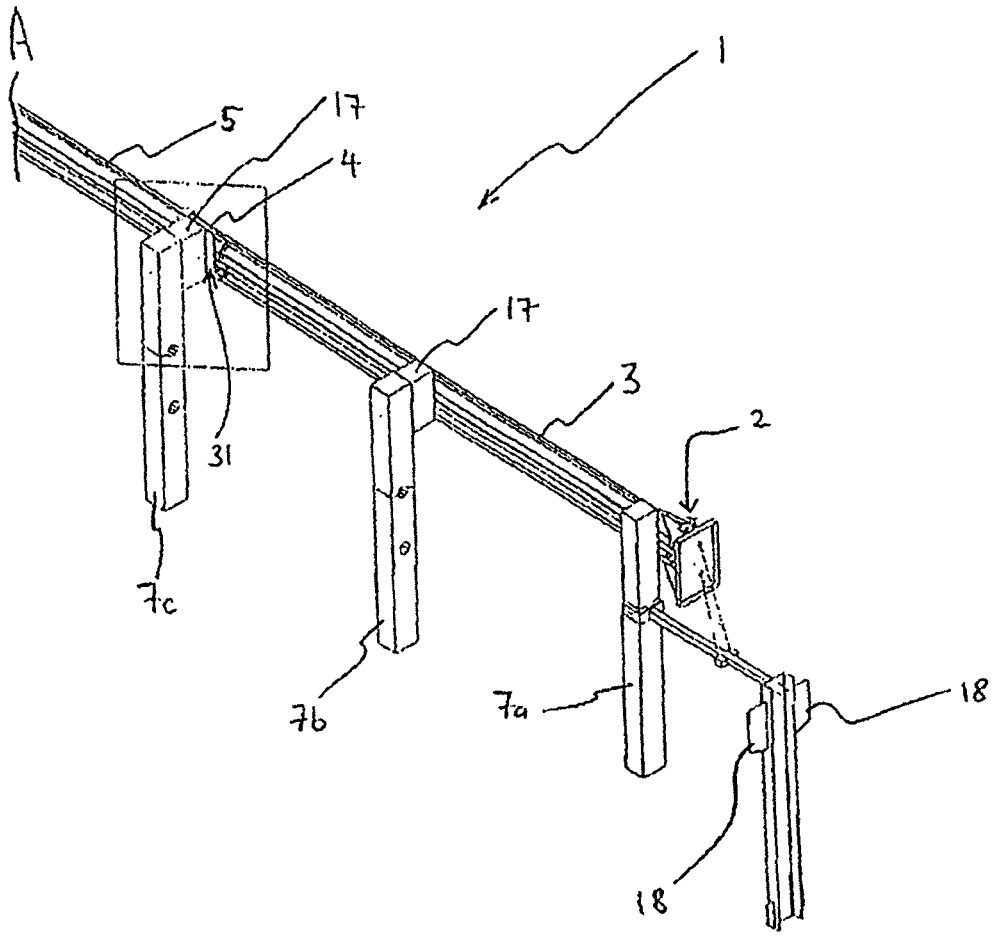
FIG. 4: is an alternative embodiment of the guardrail of FIG. 2*a*.
Figure 5:
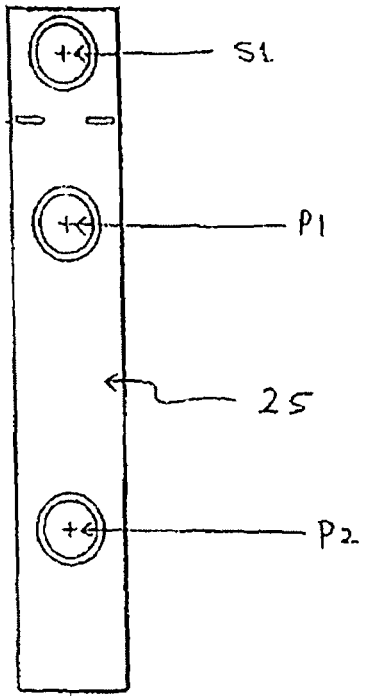
FIG. 5: is a front elevational view of one embodiment of a cable routing means according to the present invention.
Figure 6B:
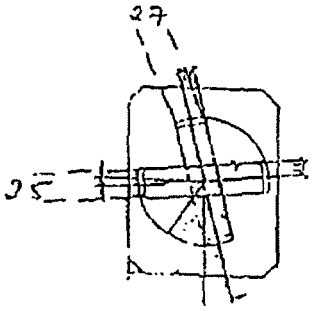
FIG. 6*b*: is a plan view illustrating the rotation through which the cable routing means of FIG. 6*a* moves to a second cable gripping orientation.
Figure 6A:
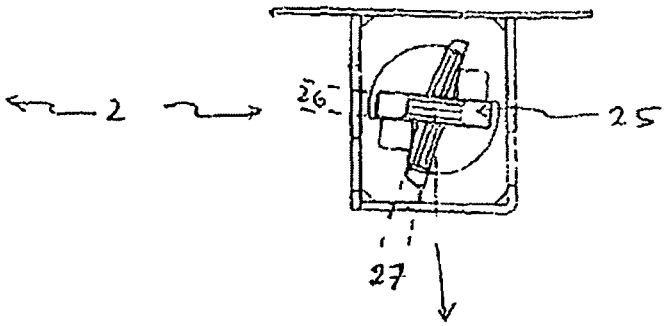
FIG. 6*a*: is a plan view of the cable routing means of FIG. 5 when in a first non-cable gripping orientation.

An alternative embodiment of the impact head is shown in FIG. 4. The impact head 24 includes: at least one cable routing means through which a cable is threaded in a tortuous path and which thereby provides resistance to cable movement therethrough. Ideally, the path of the cable through the cable routing means includes at least one substantially 180° turn, or is in a substantially S or Z-shape.

Advantageously, during a collision, or impact, with the impact head 24, the at least one cable is forced through the cable gripping means 2, where resistance to cable movement substantially facilitates impact energy dissipation.

The cable routing means may be a planar bar member 25 adapted to receive and allow at least one cable to pass therethrough via at least three cable entry ports in series which are formed therein, forming the tortuous path which provides resistance to cable movement therethrough, such as is illustrated in FIGS. 1*a* and 2*a*.

Alternatively, in an alternative embodiment of the impact head as illustrated in FIGS. 3, 4, 5, 6*a* and 6*b* a bar member 25 can be provided with a cable entry port or ports P1, P2 adapted to receive and allow at least one cable to pass directly therethrough, when said bar member is in a first non-cable-gripping orientation 26. Subsequently, upon rotation of the bar member about its longitudinal axis (substantially perpendicular to the cables length) through at least 90°, a second cable-gripping orientation 27 is reached. Advantageously, the bar member may be secured in the second orientation by locking means (not shown), such as by bolts or screws. The rotation of the bar member 25 from said first orientation to the second orientation ensures that the at least one cable follows a tortuous pathway. The rotation of the bar member 25 may be undertaken, for example by a crow bar inserted into a slot, S1, and then an angular or rotational force applied.

In use, energy from a head on impact with the impact head/cable gripping means 2 is initially substantially absorbed by support post (7*a*), which may subsequently fail, preferably substantially at or near ground level 16. For example the first support post 7*a* would normally be impacted at or by the impact head/cable gripping means, and absorb energy before preferably failing (that is, being broken). Should a support post fail and be broken off at a height substantially above ground level than that would contact the impacting vehicle and then the vehicle may collide with the broken post and result in more severe impact energy absorption (possibly resulting in vehicle occupant damage due to sudden movement arrest).

Similarly, as the slider device 4, impact head/cable gripping means 2 and first rail 3 (and subsequent rails) telescope down the second rail 5, rail 3 upon rail 5, each support post is impacted by the slider device 4 and preferably causes breakaway of the posts. Alternatively, a guardrail may also be provided in which just an impact slider is connected to the rails, and no cable gripping means or impact head is attached.

Preferably, the guardrail system employs energy absorption/dissipation systems which substantially control an impacting object momentum and directional motion. For example, energy may be absorbed or dissipated by the friction between the cable 15 and cable gripping means 2. When the guardrail is impacted end on (that is, in the substantially longitudinal direction of the guardrail and impacting the impact head and/or cable gripping means initially), the whole of rail 3, the impact head/cable gripping means 2 and the impact slider device 4 move back in a telescoping manner over rail 5 and then subsequent downstream rails, such as rail 5 and/or rail 6. Energy is also absorbed by the friction of the cables 15 running through the cable gripping means 2, wherein the threaded cable configuration through the cable routing means follows the tortuous pathway.

Preferably, as the cable gripping means 2 is attached to or forms an integral part of a bumper or impact head, as the impact head and cable gripping means move (as a result of an end-on impact with the Impact head/guardrail), away from the cable anchor point 11, the cable gripping means is effectively forced to move along the cable(s), whilst the cable(s) 15, 15*a* remain substantially stationary as a result of being fixed at each of their ends. In doing so, the cable is forced through a number of bending movements created by the threading configuration in the cable gripping means. Preferably, the cable used has substantial resistance to flexing (such as steel cable), and energy is dissipated from the impact and imparted to energy used to bend the cable.

Additionally, as the cable gripping means 2 moves along the cable(s) 15 and 15*a*, the cable is forced to run in surface-to-surface contact with the cable gripping means, which preferably results in additional frictional energy dissipation. In an even further alternative embodiment, the cable gripping means 2 may be in the form of a sleeve fitted around the cable 15, 15*a*, which is snug around the cable and provides frictional resistance to relative movement of either the sleeve or cable.

In an even further preferred energy dissipation system, the friction created by the impact slider device 4 (and rails 3, 5, 6) moving over one another during an impact event may help to absorb energy.

Energy from a side angle impact with the guardrail 1 is absorbed by the flexion and/or deformation (whether by elastic or plastic deformation) of the rails, as well as by the tensile forces created in the cable(s) 15, 15*a* (which may help the rails to resist flexion and/or deformation).

Preferably, the impacting object is redirected away from the guardrail 1 and the forces generated by the impact are distributed throughout the rails and cables either by deformation or tension generated in the cables and subsequently redirected to the cable fixing point.

Preferably, a number of support posts 7*a*-7*g* may be frangible or of a pre-determined failure load which fail or substantially deform, consequently absorbing further impact energy.

Preferably an object, such as a vehicle, involved in a side angle impact is substantially redirected away from the guardrail, and back onto the road, and the guardrail itself is restrained from "gating" by the further tension created in the cables by the impacts induced lateral cable movement.

In particular, a frangible post construction as illustrated in FIG. 8 may be especially suitable for re-directing an errant side-impacting vehicle back onto the road. The frangible post has a first member 28 connected substantially orthogonally to a second member 29. The first member is provided with at least one region of weakness 30. Advantageously, this configuration allows a substantially frangible or weakened region to exist in the first member which may be more likely to be structurally affected during an impact, for example in direction T. In contrast, an impact in line with the second member will require a greater impact force to structurally affect the second member or post, for example in direction U.

In other words, because the first member is weakened in relation to an impact in a first direction and the second member has effectively no structural resistance to a force in that direction, the post will tend to bend or break at the weakened region when subjected to that force. In contrast, when impacted by a force substantially perpendicular to the first direction, the region of weakness in the first member has little effect on the frangibility of the post and the second member offers substantial resistance to deflection in that direction.

The first and second members need not be attached to one another at exactly 90°, however this orientation may be most suitable for use with a guardrail where impacts are generally received either in-line with the longitudinal axis of the guardrail, or substantially perpendicular to the guardrail.

The frangible post is designed to more easily structurally fail in an impact from a direction substantially in line with the longitudinal axis of the guardrail than in an impact substantially perpendicular to the guardrail.

The at least one region of weakness can be formed by a cut-away section 30 from the first member, or other similar notches or portions of the first member being removed. The frangible post formed may be selected from the following configurations: an I-beam, an L-beam, an X-beam, a T-beam, a Z-beam. The configuration chosen may depend on the post geometry required by a user. The first and second members are preferably integrally formed or welded together.

Ideally, each post is sunk into the ground, with the at least one region of weakness being at or near to ground level; which allows the post to break off at or near ground level during a post failure impact.

For example, an I-beam configuration of the post as illustrated in FIG. 8*b*, should be aligned so that the first members are parallel with the road (and therefore guardrail). Each edge of the first member having a 12 mm deep triangular notch removed from the first member, the first member of which has dimensions (excluding length) is about 100 mm in width, and of about 20 mm thickness. Such notches should preferably be made so that they are approximately 50 mm below ground level (after the post has been "sunk").

During an impact in an axial direction to the guardrail, a tear in the first member starts in the upstream note from the impact, while the downstream notch allows the first member to collapse and/or fail.

Preferably, the guardrail as described above may be utilised in applications where protective barriers are required to separate vehicle traffic flow from each other, or safety to pedestrians from vehicles, or even to protect vehicles running off roads. It is desirable that the guardrail as described provides a non-gating design and which re-directs an errant vehicle from its correct path back onto a road or at least away from pedestrians on a footpath.

The guardrail as described goes at least some way toward facilitating a system for controllably slowing a vehicle during an end-on barrier impact, as well as some way towards preventing the guardrail from gating during a side angled impact. It is also preferable that the "length of need" is substantially reduced compared to various existing technologies, and may most preferably have a length of need of almost zero distance.

The guardrail as described may be utilised to form a part of whole of a guardrail system, although this system in particular may be applied to the terminal ends of a required guardrail or barrier or be substantially retrofit-able to existing guardrails.

Figure 9:
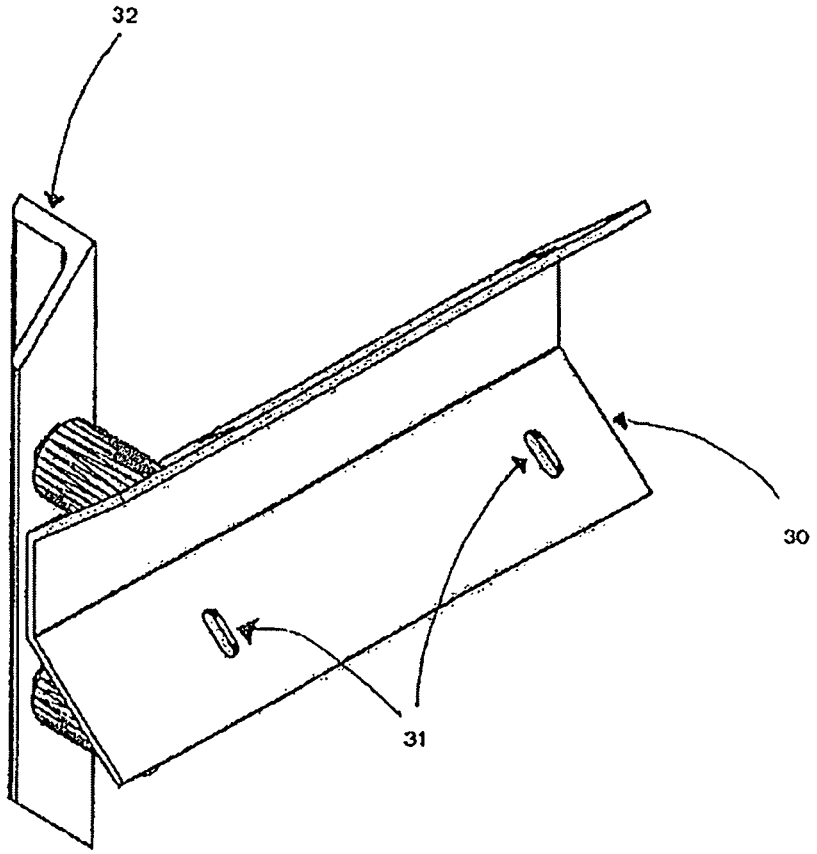
FIG. 9: is a perspective view of an impact slider according to a preferred embodiment of the invention.
Figure 10:
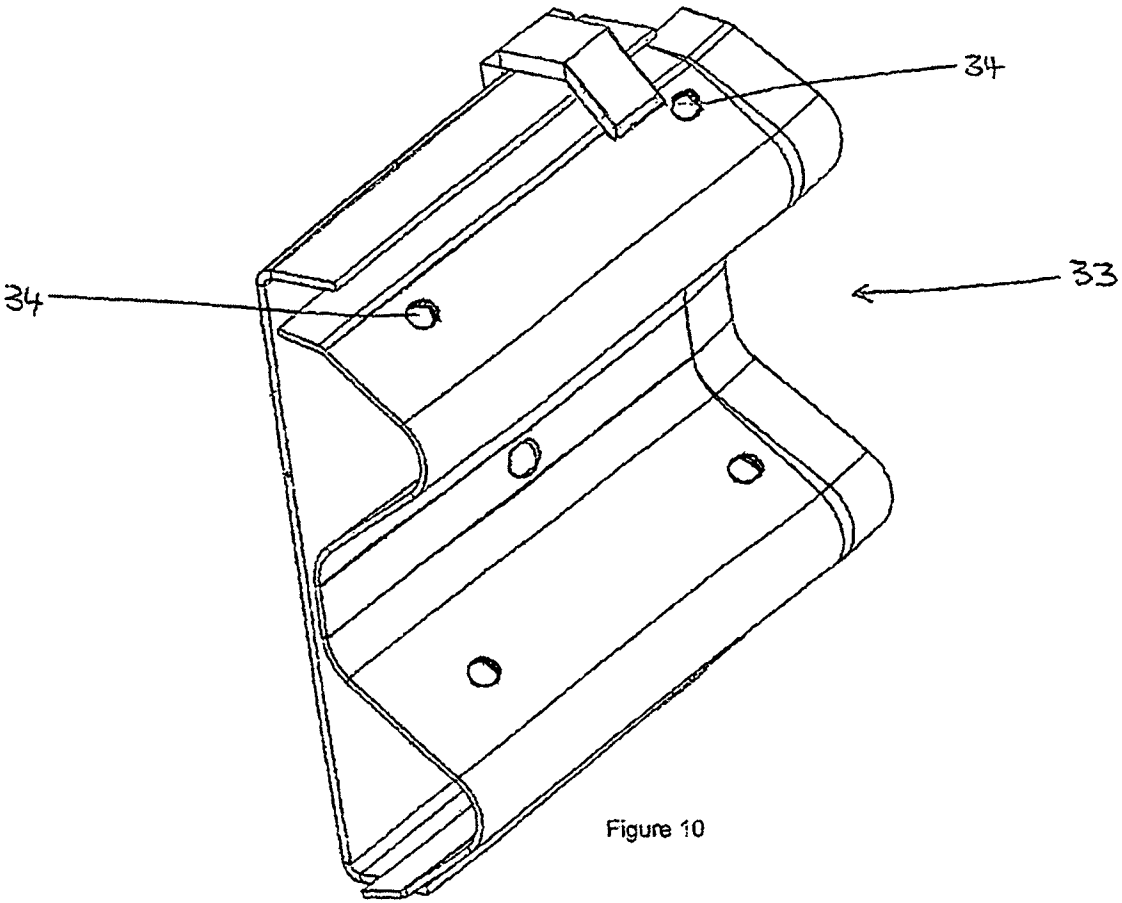
FIG. 10: shows an impact slider bracket (not attached to support posts) according to a preferred embodiment of the invention.

FIG. 10 shows an impact slider which includes means for attachment to a first rail in the form of a slider (33) which substantially conforms with the rail profile and with integral means for attachment to said first rail in the form of slotted holes (34) through which, in one preferred embodiment, fasteners may be passed and secured to said first rail. In use the angle bar shown (32) in FIG. 9 may butt up against one end of the impact slider 33 so as to hold the first rail 100 (not shown in FIGS. 9 and 10 but shown in FIG. 11) within the impact slider 33, thereby providing support via the support post 101 and spacer (if present). At least one cable 103 may be connected to the cable gripping means 2 (FIG. 1A).

The impact slider bracket (30) also has means for attachment (31) via fasteners to the second rail 102, although this is a preferred embodiment and, in other embodiments, the impact slider bracket may be attached only to the second rail, or to both the first and second rail.

Figure 11:
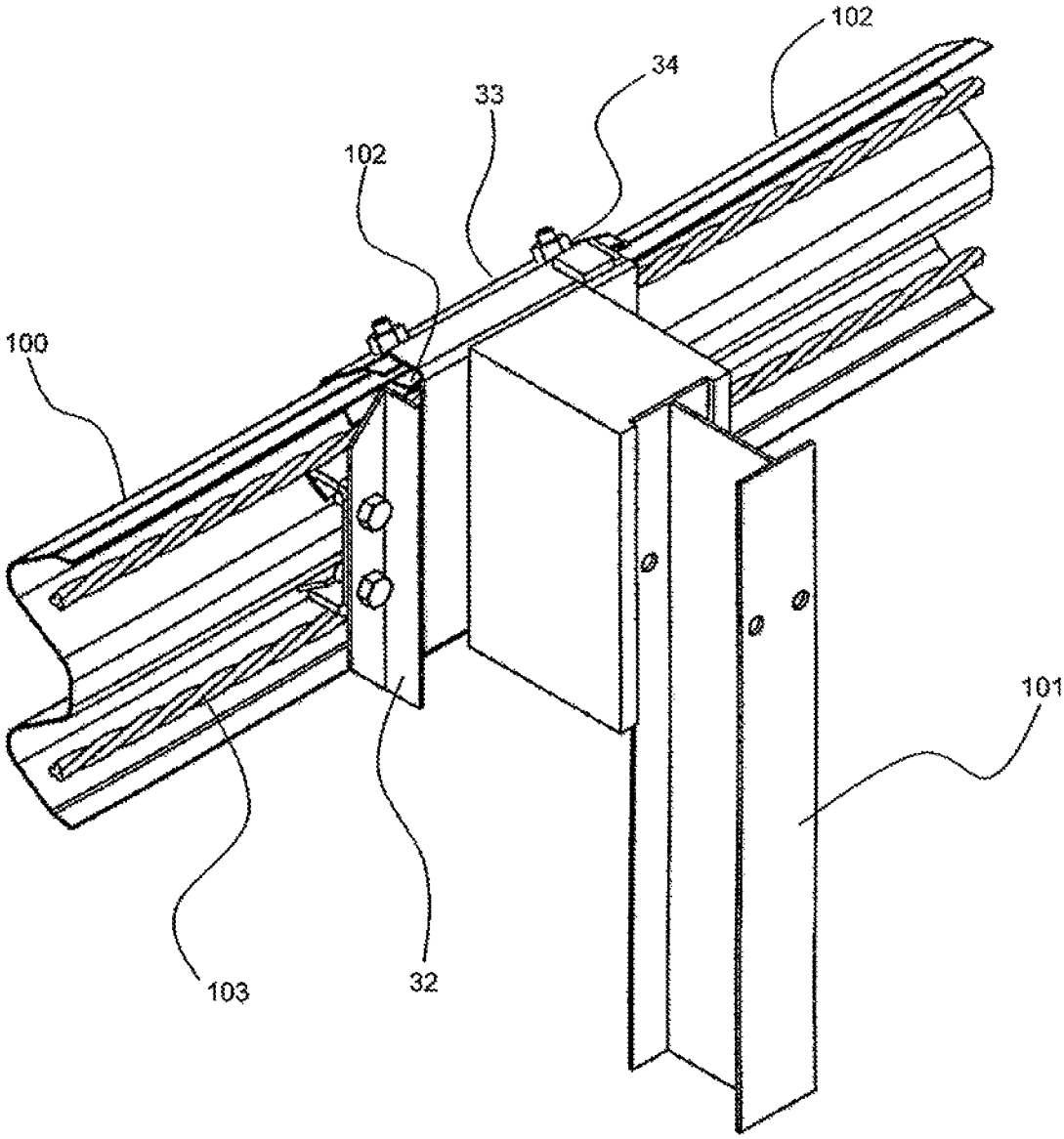
FIG. 11: is a view of a preferred impact slider assembly according to the invention as mounted to the support post.

In use and upon impact the impact slider may cause the impact slider bracket to come free of the support post by breaking the frangible fastening of the impact slider bracket to the support post (whether via a spacer or not). In end on impacts, as the impact slider (33) still surrounds both the first and second rails it may gather telescoping rails approaching from the left hand side in FIG. 11 whilst maintaining or at least substantially maintaining the rails in a "non-gating" configuration, that is, that the first rail (that shown on the left hand side of FIG. 11) may move substantially along the length of the second rail 102 (shown on the right in FIG. 11) so that a vehicle approaching from the traffic side of the rail (the top left hand corner as viewed in FIG. 11) has a low probability of penetrating through to the protected side (the bottom right corner as shown in FIG. 11) and thereby preventing "gating" of the rails.

The L shaped angle bracket (32) is attached to the impact slider bracket (30) and upon side impacts on the rails, prevents the joint between rails one and two from separating. This is achieved by the L shaped angle bracket (32) being larger than the slider (33) and therefore being unable to pass through the slider (33).

Aspects of the present invention have been described by way of example only and it should be appreciated that modifications and additions may be made thereto without departing from the scope of the appended claims.

I claim:

1. A guardrail system comprising:

a first rail;

a second rail telescopingly arranged with said first rail;

a slider mechanism configured to fit over and substantially surround said first rail and said second rail, and shaped to substantially conform with a profile of at least one of said first rail and said second rail, said slider mechanism having an integral attachment portion for attaching the slider mechanism to said first rail, wherein said first rail and said second rail telescopingly slide within said slider mechanism during a side-angled impact to substantially prevent gating of said first and second rails; and an angled bracket attached to at least one of said first rail and said second rail and which abuts against at least one edge of said slider mechanism, wherein said angled bracket is substantially L-shaped and is larger in profile that said slider mechanism for preventing said angled bracket from passing through said slider mechanism, wherein said angled bracket is fastened to a slider bracket, and wherein said angled bracket and said slider bracket are configured for preventing a joint between said first rail and said second rail from separating during an impact.

2. The guardrail system of claim 1, wherein the slider mechanism includes at least one fastener which is configured to pass through and secure the first rail to the slider mechanism.

3. The guardrail system of claim 1, wherein the slider bracket is configured for attachment to at least the second rail.

4. The guardrail system of claim 1, wherein each of the first and second rails have a top edge and a bottom edge, and the slider mechanism is shaped to substantially conform with an entire profile defined between the top edge and the bottom edge of at least one of the first rail and the second rail.

5. A guardrail system, comprising:

a first rail;

a second rail telescopingly arranged with said first rail;

a slider assembly configured to fit over and substantially surround said first rail and said second rail, and shaped to substantially conform with a profile of at least one of said first rail and said second rail, said slider assembly attached to said first rail; and an angled bar which abuts against at least one edge of said slider assembly, said angled bar being attached to an upstream end of said second rail which protrudes through said slider assembly, wherein said angled bar is larger in profile than said slider assembly for preventing said angled bar from passing through said slider assembly, wherein said first rail and said second rail telescopingly slide with respect to one another within said slider assembly during a head-on impact with said guardrail system but said first and second rails do not slide within said slider assembly during a side-angled impact, due to said angled bar inhibiting such movement, to substantially prevent gating of said first and second rails.

6. The guardrail system of claim 5, wherein said slider assembly includes at least one fastener which is configured to pass through and secure said first rail to said slider assembly.

7. The guardrail system of claim 5, further including a slider bracket fastened to said angled bracket and configured for attachment to at least said second rail.

8. The guardrail system of claim 5, wherein each of said first and second rails have a top edge and a bottom edge, and said slider assembly is shaped to substantially conform with an entire profile defined between said top edge and said bottom edge of at least one of said first rail and said second rail.

9. The guardrail system of claim 5, wherein said angled bracket is substantially L-shaped.

* * * * *